US006754911B1

(12) United States Patent
Howell

(10) Patent No.: US 6,754,911 B1
(45) Date of Patent: Jun. 29, 2004

(54) MODULAR HELMET EAR CUP TENSIONER

(75) Inventor: Frank A. Howell, Oxford, ME (US)

(73) Assignee: Down East, Inc., Bridgton, ME (US)

( * ) Notice: Subject to any disclaimer, the term of this patent is extended or adjusted under 35 U.S.C. 154(b) by 0 days.

(21) Appl. No.: 10/431,702

(22) Filed: May 7, 2003

(51) Int. Cl.[7] ..... A42B 1/24
(52) U.S. Cl. ..... 2/422; 2/209; 2/423
(58) Field of Search ..... 2/422, 423, 209, 2/6.1, 6.2, 6.6; 181/129; 381/376

(56) References Cited

U.S. PATENT DOCUMENTS 3,815,155 A * 6/1974 Davison et al. ..... 2/209
3,864,756 A * 2/1975 Desimone ..... 2/423
4,347,631 A * 9/1982 Newcomb ..... 2/423
4,944,361 A * 7/1990 Lindgren et al. ..... 181/129
5,603,117 A * 2/1997 Hudner et al. ..... 2/6.6
5,860,166 A * 1/1999 Ritts ..... 2/209

* cited by examiner

*Primary Examiner*—Rodney M. Lindsey
(74) *Attorney, Agent, or Firm*—Gauthier & Connors

(57) ABSTRACT

A device for mounting a noise attenuating ear cup on a helmet shell. The device includes a clamp plate, which is secured to the shell in an operative position extending along a side edge of the shell. A flexible strap extends along an inner surface of the clamp plate. The strap has first and second ends and an intermediate portion bulging inwardly from the inner surface of the clamp plate. The ear cup is attached to the intermediate portion of the strap, and the first end of the strap is anchored to the clamp plate. The second end of the strap is adjustably constrained for longitudinal movement relative to the clamp plate to thereby vary the extent to which the intermediate portion of the strap bulges inwardly from the inner surface of the clamp plate.

5 Claims, 4 Drawing Sheets

MODULAR HELMET EAR CUP TENSIONER

BACKGROUND OF THE INVENTION

1. Field of the Invention

This invention relates generally to noise attenuation, and is concerned in particular with an improved device for adjustably mounting noise attenuating ear cups on the helmet shells worn by military personnel and workers in various industrial environments.

2. Description of the Prior Art

Noisy environments such as those found in tanks, helicopters, and other military vehicles present a need to protect the occupants' hearing during prolonged exposure, without impairing clear radio/intercom communication, and while maximizing both wearer comfort and the surface area protected by the helmet.

Prior art approaches typically rely on large cutouts in the sides of the helmet protective shell to accommodate protruding ear cups. Clamping springs and/or chin straps are used to apply sufficient inward force to achieve an effective sonic seal around the ears. This approach has a number of limitations. For example, the cutouts in the sides of the helmet shell reduce the protected area. The forces applied by the clamping springs are not readily adjustable, and thus comfort cannot be maximized by minimizing clamping forces as conditions warrant. Also, chin straps restrict jaw movement, have limited clamping ability, and can chafe the skin with prolonged use.

Another prior art approach combines low profile ear cups mounted on a clamping spring band that loops over the top of the wearer's head. Once the ear cups are in place, the protective helmet with its crown padding removed, is donned over the spring band.

While this approach does not require large cutouts in the helmet shell, it too has other drawbacks. More particularly, the clamping forces applied by the spring bands are not readily adjustable for comfort and effective sonic sealing. Also, handling the separate helmet and ear cup/headband assembly is inconvenient. Chin straps are still necessary in order to stabilize the helmet shell.

For commercial applications that do not require military-type protection, the protective shell typically does not encroach below the top of the wearer's ears. Here, long spring levers with attached ear cups protrude from mounting points on the shell down past its brim to ear level. While this approach does not require a chin strap to stabilize the helmet, clamping forces are again not readily adjustable for comfort and effective sonic sealing. Moreover, the spring levers are prominent, delicate and vulnerable to damage during normal use.

The overall objective of the present invention is to provide an improved device for mounting noise attenuating ear cups to helmet shells in a manner that supports clear radio/intercom communication while maximizing wearer comfort and without reducing the surface area protected by the helmet.

SUMMARY OF THE INVENTION

Devices in accordance with the present invention includes clamp plates secured to the helmet shell in operative positions extending along side edges of the shell. Flexible straps extends along inner surfaces of the clamp plates. The straps have first ends anchored to the clamp plates, intermediate portions bulging inwardly from the clamp plates, and opposite second ends constrained for longitudinal movement relative to the clamp plates. The ear cups are attached to and supported exclusively by the intermediate strap portions. By longitudinally adjusting the second strap ends, the extent to which the intermediate strap portions bulge inwardly can be adjusted to thereby effect a corresponding adjustment of the inward forces being applied to the ear cups against the wearer's head.

Other features and advantages of the present invention will now be described in greater detail with reference to the accompanying drawings, wherein:

DETAILED DESCRIPTION OF PREFERRED EMBODIMENT

Figure 1:
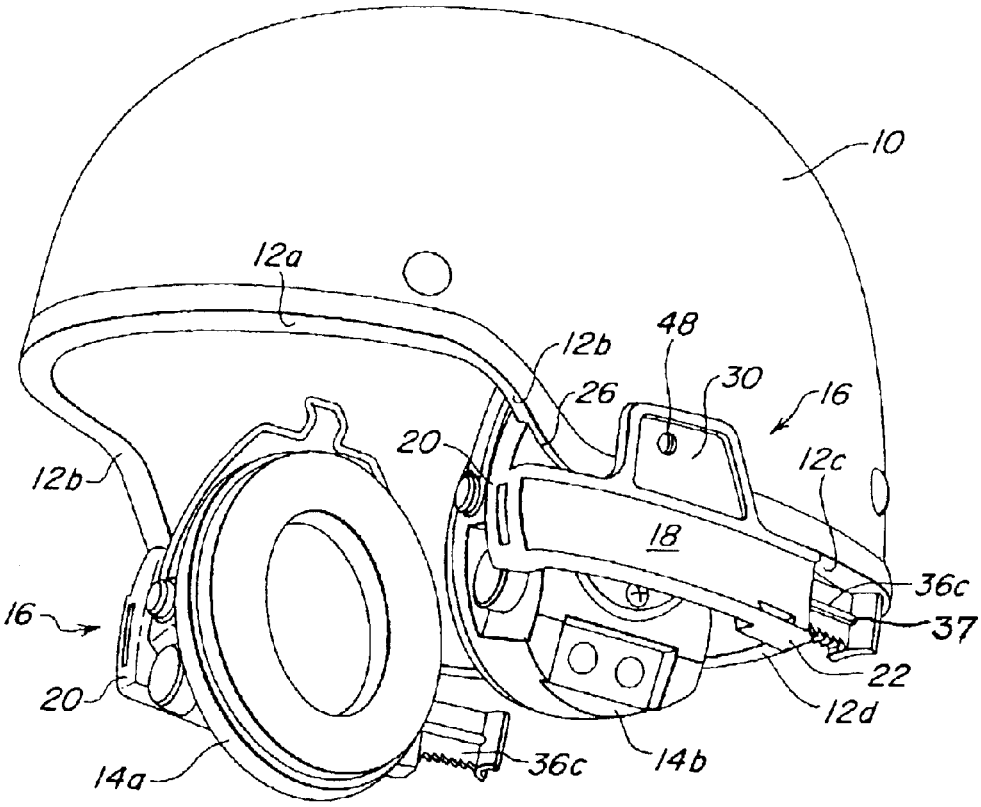
FIG. 1 is a perspective view of a military helmet shell to which noise attenuating ear cups have been attached by mounting devices in accordance with the present invention.
Figure 2:
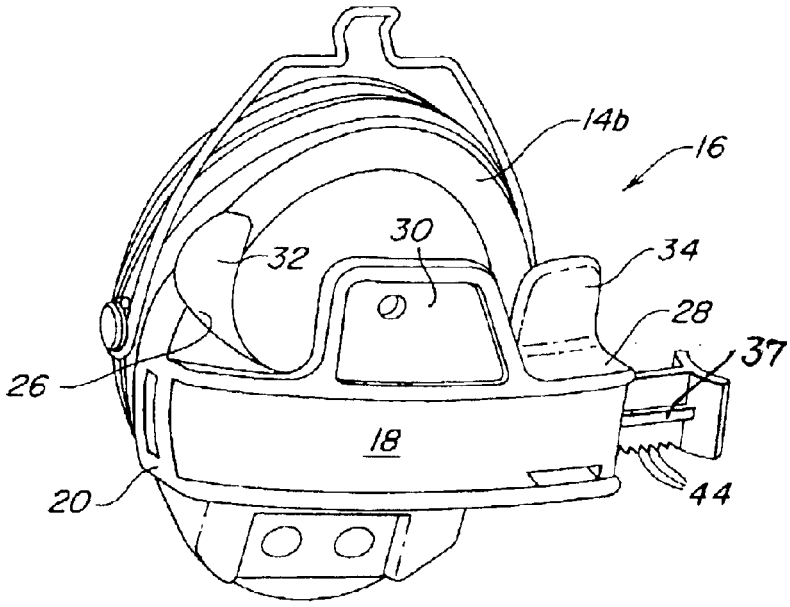
FIG. 2 is a perspective view of the left ear cup and associated mounting device removed from the helmet shell.

With reference initially to FIG. 1, a military helmet shell 10 is shown with a raised front edge 12*a*, and contoured intermediate edges 12*b* extending downwardly to side edges 12*c* which in turn lead to a bottom back edge 12*d*. Right and left ear cups 14*a*, 14*b* are mounted respectively to opposite sides of the helmet shell by devices in accordance with the present invention and generally indicated at 16.

The mounting devices are mirror images of each other, and thus a description of one applies equally as well to the other.

With reference additionally to FIGS. 2–5, it will be seen that the mounting devices each include a clamp plate 18 curved to approximate the curvature of the helmet shell. The mounting plates have front and rear bosses 20, 22 protruding inwardly from concave inner surfaces 24. The front bosses 20 include curved locator surfaces 26 configured to correspond to the curvature of respective intermediate edges 12*b* of the helmet shell, and the rear bosses 22 are similarly provided with flat locator surfaces 28 arranged to contact respective side edges 12*c* of the helmet shell. Outer hook members 30 project upwardly from midsections of the clamp plates, and front and rear inner hook members 32, 34 project upwardly from the front and rear locator surfaces 26, 28.

Flexible straps 36 extend along the concave inner surfaces 24 of the clamp plates. The straps 36 have front ends 36*a* anchored as at 38 (see FIG. 3) in the front bosses 20. Intermediate portions 36*b* of the straps bulge inwardly from the clamp inner surfaces 24, and rear ends 36*c* are constrained within slots in the rear bosses 22 for longitudinal movement relative to the clamp plates. As can best be seen in FIG. 5, the intermediate strap portions 36*b* are threaded through slots 40 and beneath ribs 42 on the inner surfaces of the ear cups. With this arrangement, the ear cups are supported exclusively by the intermediate strap portions 36*b*, and are free to slide and pivot thereon.

Figure 3:
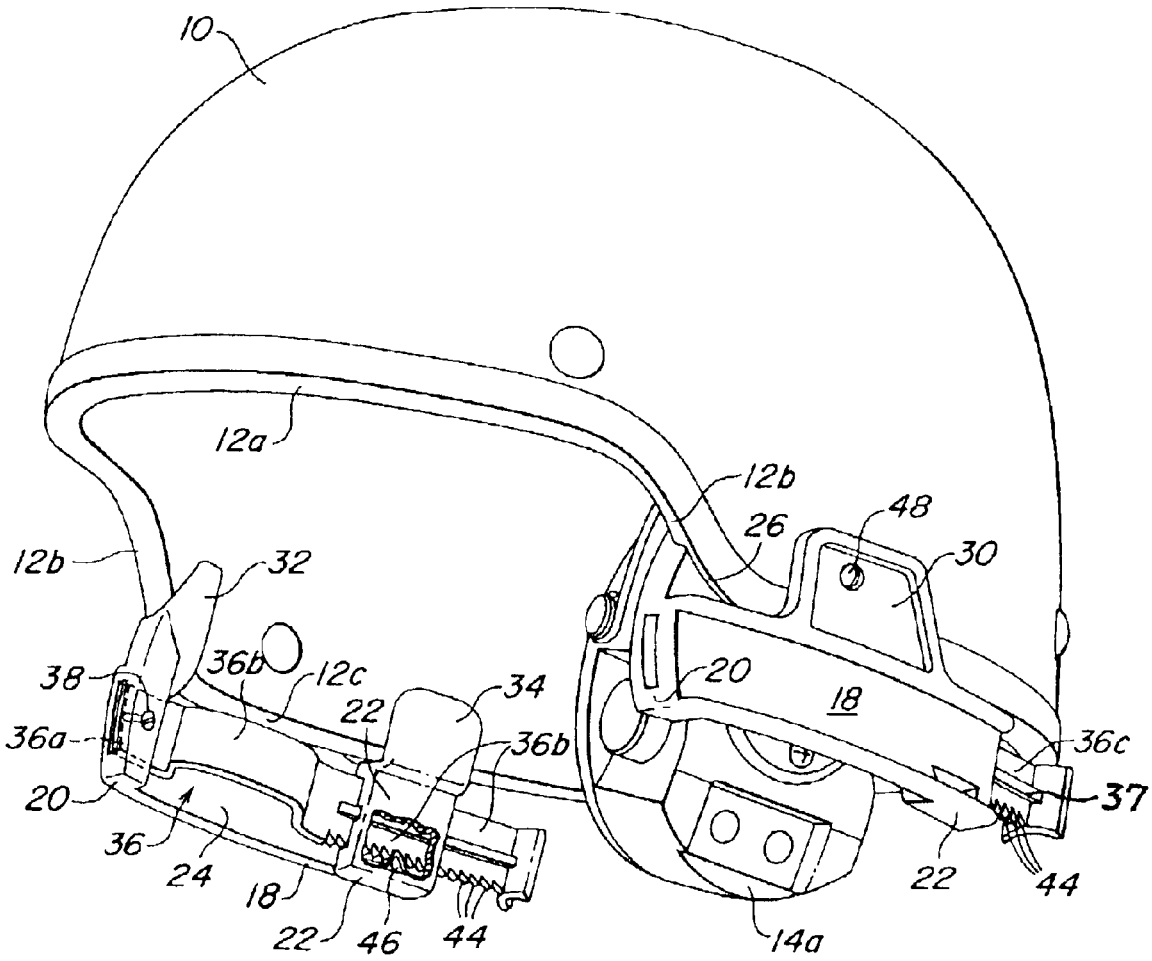
FIG. 3 is a perspective view of the helmet shell with the right ear cup removed from its mounting device.
Figure 4:
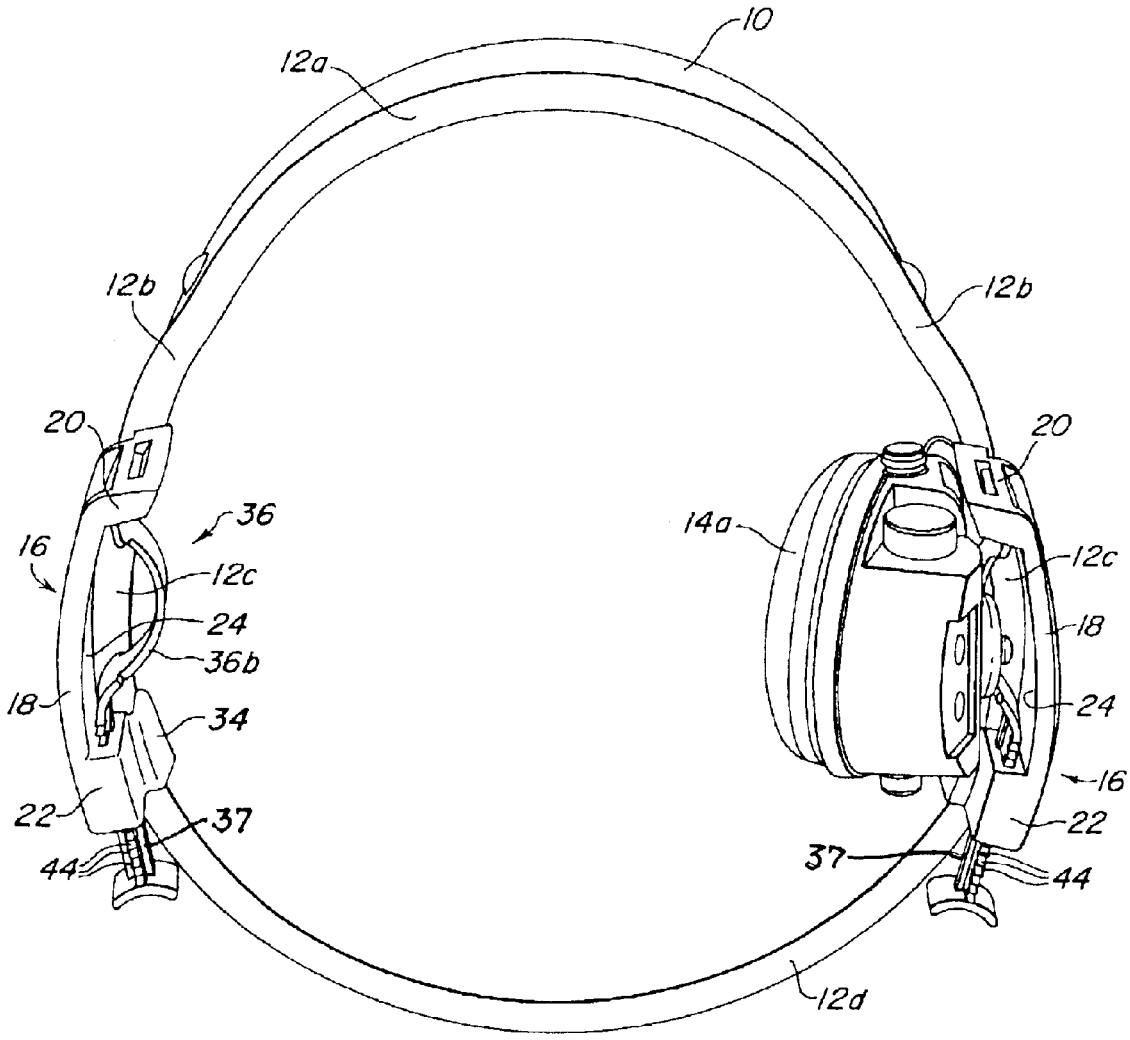
FIG. 4 is a bottom view of the helmet shell as shown in FIG. 3.
Figure 5:
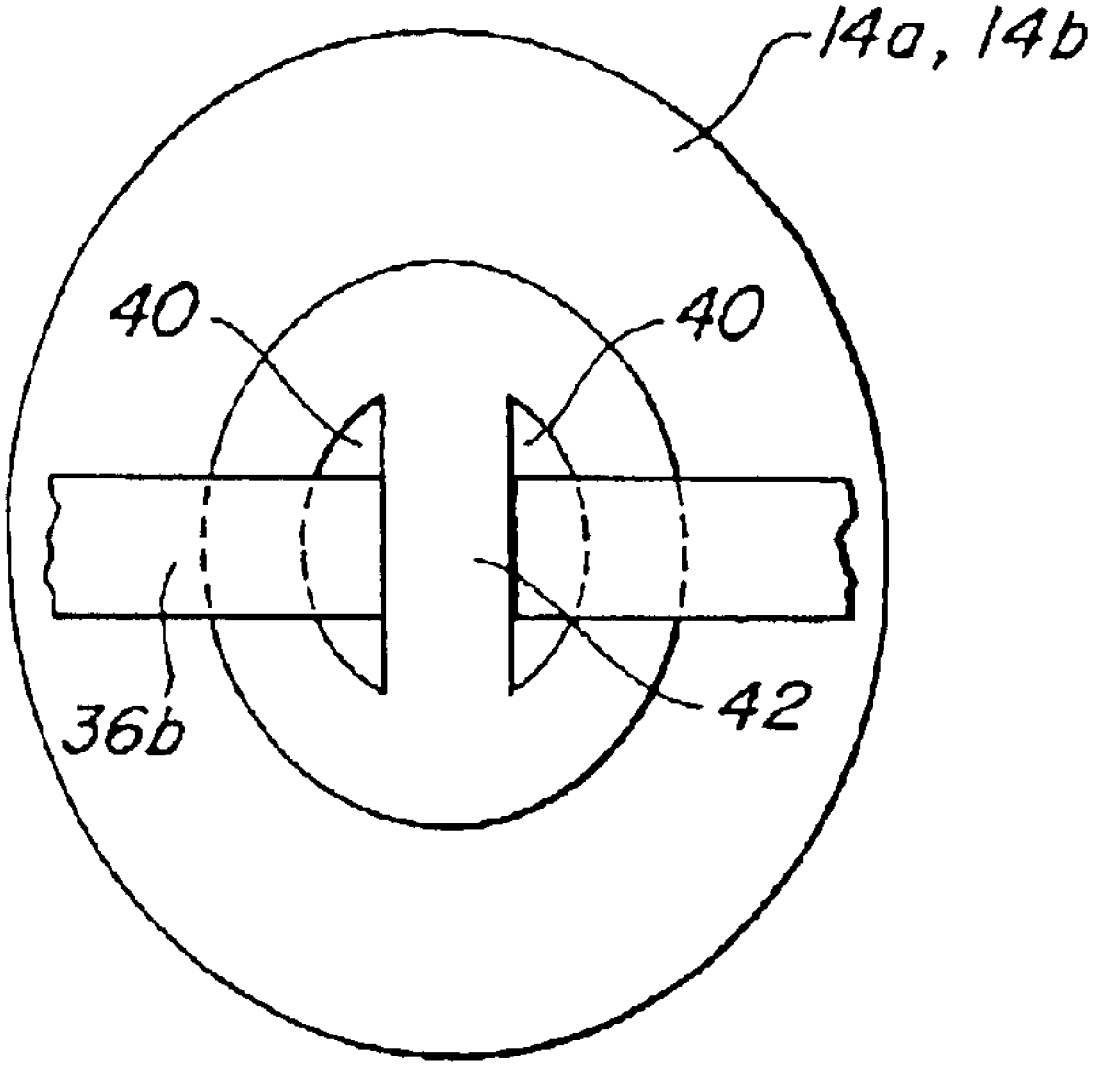
FIG. 5 is a partial view showing the connection between each ear cup and its respective support strap.

The rear ends 36*c* of the strap members are provided with ratchet teeth 44 which, as can best be seen in FIG. 3, are configured to engage interior pawls 46. Laterally projecting ribs 37 extend along opposite faces of the rear strap portions 36*c*. The ribs 37 serve to stiffen the rear strap portions against flexing as they are pressed forwardly when making inward adjustments to the ear cups.

The front and rear bosses 20, 22 with their respective locator surfaces 26, 28 and inner hook member 32, 34 coact with the outer hook members 30 to secure the clamp plates 18 to the helmet shell in operative positions extending along the side edges 12*c*. More particularly, the front and rear locator surfaces 26, 28 engage the shell edges 12*b*, 12*c*, the inner hook members 32, 34 extend upwardly along the inner shell surface, and the outer hook members 30 extend upwardly along the outer shell surface. Fasteners 48 secure the outer hooks 30 to the shell.

When thus mounted, the contact of the inner hooks 32, 34 with the inner shell surface prevents the clamp plates 18 from flexing outwardly as pressure is applied to the ear cups 14*a*, 14*b*. The contact of the locator surfaces 26, 28 with the shell edges 12*b*, 12*c* prevents the clamp plates from pivoting about the axes of the fasteners 48.

The ear cups 14*a*, 14*b* are urged inwardly by pushing the rear strap ends 36*c* forwardly toward the front of the helmet shell. The ratchet teeth 44 ride over the pawls 46 as the intermediate strap portions 36*b* are bulged inwardly to apply pressure to the ear cups. The straps lock at selected positions of adjustment, and may be released by pushing them upwardly to temporarily release the teeth 44 from the pawls 46.

Comfort, safety and durability are maximized by the flexibility of the straps 36 and the ability of the ear cups to slide and pivot on them. Under severe impact or load, the straps will deform, dissipating energy, and then return to their original positions. Each strap is individually adjustable to enable each ear cup to be exactly positioned for maximum comfort and sonic sealing.

I claim:

1. A device for mounting a noise attenuating ear cup on a helmet shell, said device comprising:

a clamp plate;

mounting means for securing said clamp plate to said shell in an operative position extending along a side edge of said shell;

a flexible strap extending along an inner surface of said clamp plate, said strap having first and second ends and an intermediate portion bulging inwardly from the inner surface of said clamp plate;

means for attaching the ear cup to the intermediate portion of said strap;

means for anchoring the first end of said strap to the clamp plate; and adjustment means for constraining the second end of said strap for longitudinal movement relative to said clamp plate to thereby vary the extent to which the intermediate portion of said strap bulges inwardly from the inner surface of said clamp plate.

2. The device as claimed in claim 1 wherein said mounting means comprises inner and outer hook members respectively projecting upwardly from said clamp plate along inner and outer surfaces of said shell.

3. The device as claimed in claim 2 wherein said outer hook member projects upwardly from a midsection of said clamp plate, and wherein said inner hook members project upwardly from end sections of said clamp plate.

4. The device as claimed in claim 3 wherein said mounting means further comprises locator surfaces on said inner hook members, said locator surfaces being configured and arranged to contact side and front edges of the helmet shell.

5. The device as claimed in claim 1 wherein said adjustment means includes a ratchet mechanism for releasably retaining the second end of said strap in selected positions of adjustment.

* * * * *